US005926328A

United States Patent [19]

Fabian

[11] Patent Number: 5,926,328

[45] Date of Patent: Jul. 20, 1999

[54] HAND HELD MIRROR WITH MOVABLE HANDLE

[76] Inventor: David Fabian, 47 Sussex Dr., Willingboro, N.J. 08046

[21] Appl. No.: 08/808,394

[22] Filed: Feb. 28, 1997

[51] Int. Cl.[6] ..... G02B 5/08

[52] U.S. Cl. ..... 359/840; 359/875; 359/882

[58] Field of Search ..... 359/840, 872, 359/882, 838, 871, 875; 248/549, 466, 476, 478, 477; 132/316; 312/224, 225, 226, 227; 600/247

[56] References Cited

U.S. PATENT DOCUMENTS

| | | | |
|---|---|---|---|
| 163,578 | 5/1875 | Cogswell | 600/247 |
| 305,640 | 9/1884 | Starr | 359/840 |
| D. 310,584 | 9/1990 | Cadet | D28/64.1 |
| 470,211 | 3/1892 | Philips | 359/875 |
| 564,454 | 7/1896 | Ryan | 248/484 |
| 642,162 | 1/1900 | Seabury et al. | 312/226 |
| 1,021,639 | 3/1912 | Smith | 359/875 |
| 1,616,104 | 2/1927 | Bardera | 132/309 |
| 1,989,437 | 1/1935 | Weisz | 359/865 |
| 2,459,733 | 1/1949 | Macy | 132/316 |
| 2,862,420 | 12/1958 | Hazelroth | 359/844 |
| 2,939,364 | 6/1960 | Doswell et al. | 248/478 |
| 3,003,397 | 10/1961 | Jacobus | 359/875 |
| 3,377,117 | 4/1968 | Biscow | 359/549 |
| 3,992,950 | 11/1976 | Pierce | 359/872 |
| 4,852,970 | 8/1989 | Kitrell | 359/550 |
| 5,096,283 | 3/1992 | Croteau | 359/865 |
| 5,386,322 | 1/1995 | Parsons | 359/872 |
| 5,654,824 | 8/1997 | Tarr et al. | 359/882 |

*Primary Examiner*—Cassandra Spyrou
*Assistant Examiner*—John Juba, Jr.
*Attorney, Agent, or Firm*—Norman E. Lehrer

[57] ABSTRACT

A hand held mirror which allows a user to obtain a rear view while the handle of the mirror is positioned directly in front of the user. The hand held mirror comprises a mirror, a frame to which the mirror is secured and an elongated handle. A lower portion of the frame is pivotally mounted to the upper end of the handle so that the frame can pivot about the same. The frame is adapted to be releasably locked in place.

4 Claims, 2 Drawing Sheets

HAND HELD MIRROR WITH MOVABLE HANDLE

BACKGROUND OF THE INVENTION

The present invention is directed toward a hand held mirror with a movable handle and, more particularly, to such a mirror which is adapted to be pivoted about a handle so that objects can be viewed behind a person while holding the handle directly in front of himself in an upright vertical position.

Hand held mirrors are well known in the art. Heretofore, if a user of such a hand held mirror desired to utilize the same to obtain a view behind himself, he would have to position the mirror to his right or left and turn his head accordingly. Existing hand held mirrors do not allow the user of the same to hold the handle directly out in front of himself in an upright position and obtain a view from behind.

SUMMARY OF THE INVENTION

The present invention is designed to overcome the deficiency of the prior art discussed above. It is an object of this invention to provide a hand held mirror that allows a user to obtain a view from behind while holding the handle of the mirror directly and vertically out in front of himself.

It is a further object of the invention to provide such a mirror that is adapted to extend at an angle from the handle and be releasably locked in a fixed position.

In accordance with the illustrative embodiments, demonstrating features and advantages of the present invention, there is provided a hand held mirror which allows a user to obtain a rear view while the mirror is positioned directly in front of the user. The hand held mirror comprises a mirror, a frame to which the mirror is secured and an elongated handle. A lower portion of the frame is pivotally mounted to the upper end of the handle so that the frame can rotate about the same. The frame is adapted to be releasably locked in place.

Other objects, features and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
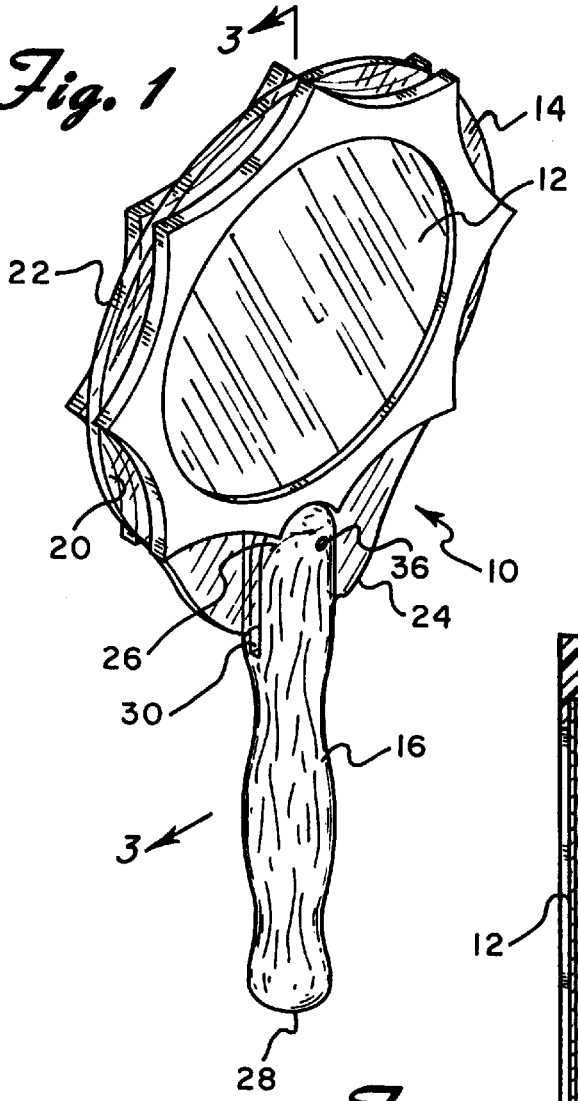
FIG. 1 is a perspective view of the hand held mirror of the present invention showing one side of the same.

Referring now to the drawings in detail wherein like reference numerals have been used throughout the various figures to designate like elements, there is shown in the figures a hand held mirror with a movable handle constructed in accordance with the principles of the present invention and designated generally as 10.

Figure 2:
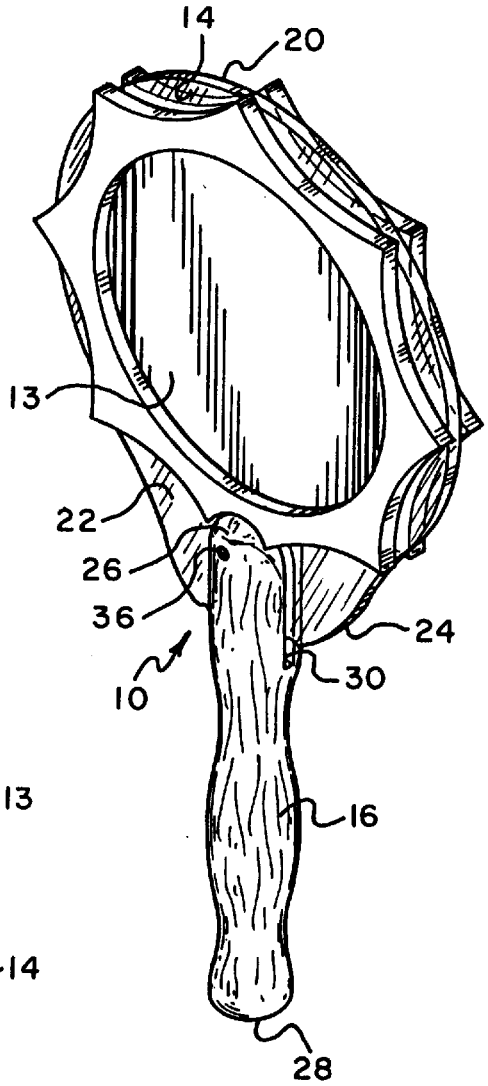
FIG. 2 is a view similar to FIG. 1 showing the other side of the hand held mirror.

The hand held mirror essentially comprises at least one mirror 12, a frame 14 and a handle 16. The frame 14 has a pair of opposing surfaces 20 and 22 and a lower portion 24. The mirror 12 is secured to surface 20 of the frame 14 in a known manner. In the preferred embodiment, there is a mirror 13 secured to the other surface 22 of the frame (FIG. 2). This other mirror can be either a magnifying mirror or have the same reflective characteristics of the mirror 12.

Figure 3:
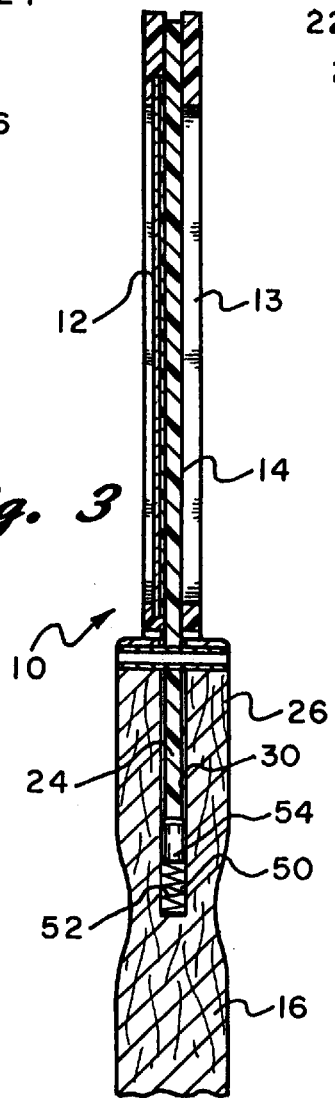
FIG. 3 is a cross-sectional view taken along lines 3—3 of FIG. 1.

The elongated handle 16 has an upper end 26 and a lower end 28 (FIGS. 1–3). The handle 16 further has a slotted opening 30 extending downwardly from the upper end 26 thereof. The lower portion 24 of the frame 14 partially extends into the slotted opening 30. A pin 36 extends through the upper end 26 of the handle 16, through the slotted opening 30 and through the lower portion 24 of the frame 14. As a result, the frame is adapted to pivot about the pin 36 around one axis and in substantially the same plane as the mirror 12.

Figure 4:
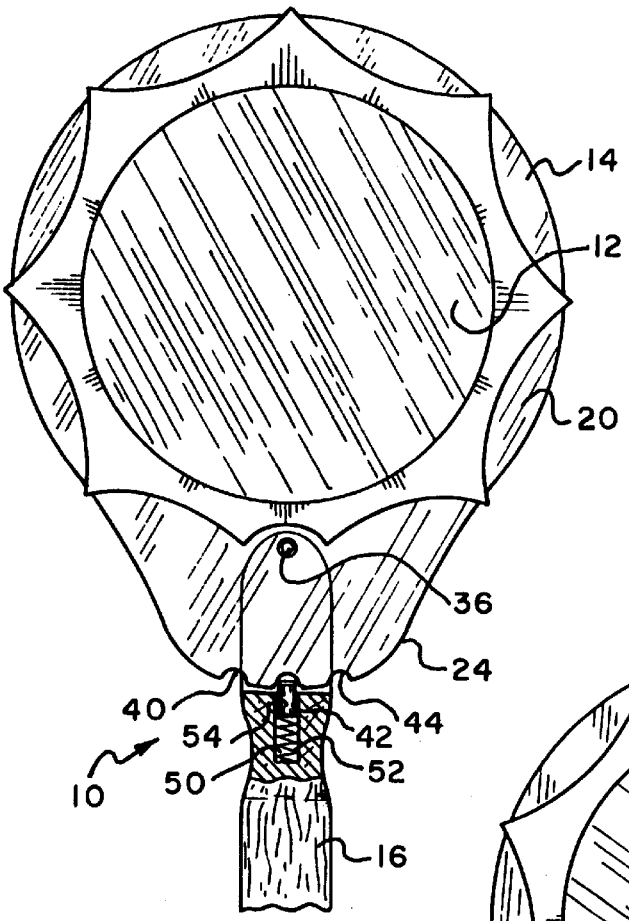
FIG. 4 is a partial front plan view showing the handle in partial cross-section.
Figure 5:
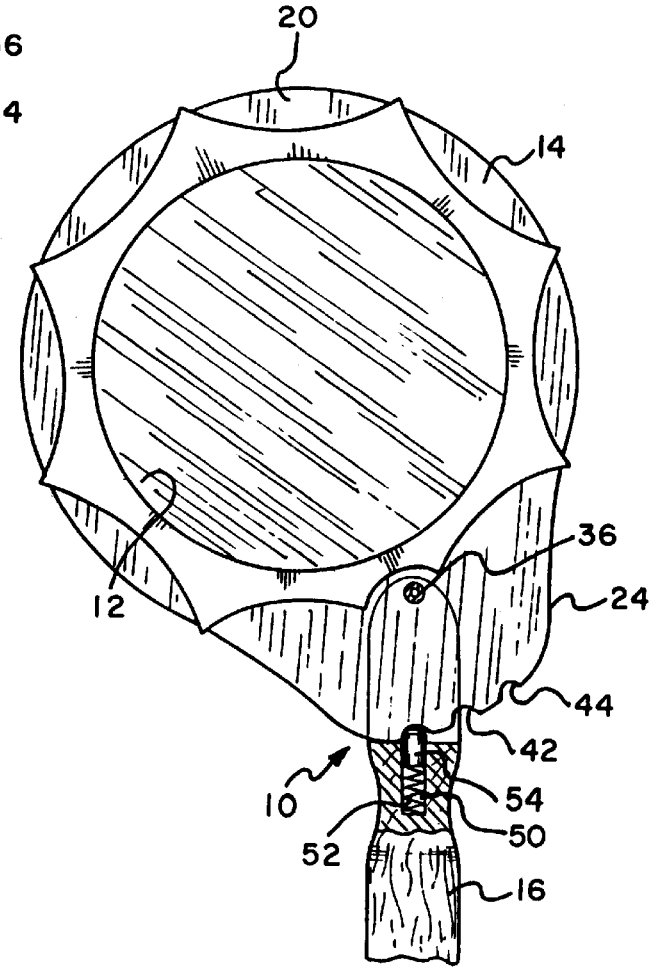
FIG. 5 is a view similar to FIG. 4 showing the mirror and frame extending at an angle from the handle.

The lower portion 24 of the frame 14 has a plurality of notches 40, 42 and 44 formed therein (FIGS. 4 and 5). The handle 16 has a cavity 50 located below the slotted opening 30 (FIGS. 3–5). Mounted within the cavity is a spring 52. A pin member 54 rests on the top of the spring 52 and is biased upwardly to partially extend above the cavity 50 and into the slotted opening 30 in the handle 16. The pin 54 is adapted to be moved further into the cavity against the restoring force of the spring. Further, the pin is adapted to releasably engage a corresponding one of the notches 40, 42 and 44 in the lower portion of the frame in order to lock the same in a fixed position.

In use, the person using the mirror 10 can position the frame so that it extends vertically from the handle or so that it extends at an angle on either side of the handle. This is accomplished by grasping the frame and rotating the handle 16 until the spring loaded pin member 54 engages one of the notches 40, 42 and 44 in the lower portion 24 of the frame 14 (FIGS. 4 and 5). In order to change the position of the frame and, therefore, the mirrors 12 and 13 secured thereto, one simply has to grasp the frame and rotate the handle about the same. As the handle is rotated, the pin member 54 is cammed downwardly into the cavity 50 in the handle 16 against the restoring forces of the spring 52. When one of the notches is positioned directly above the pin member 54, the restoring forces of the spring 52 cause the pin member 54 to releasably engage such notch in order to releasably lock the frame in a fixed position. The user of the mirror will rotate the frame so that it extends at an angle from either side of the handle when he wants to hold the handle directly out in front of him and obtain a view from behind.

The present invention may be embodied in other specific forms without departing from the spirit or essential attributes thereof and accordingly reference should be made to the appended claims rather than to the foregoing specification as indicating the scope of the invention.

What is claimed is:

1. A hand held mirror comprising: a mirror;

a frame having a pair of opposing surfaces and a lower portion, said mirror being secured to one of said opposing surfaces of said frame;

an elongated handle having an upper end and a lower end;

said lower portion of said frame being pivotally mounted to said upper end of said handle in order to allow said frame to pivot about one axis relative to said handle, said upper end of said handle including a slotted opening therein and said lower portion of said frame extending into said slotted opening, and means for locking said frame in one of a plurality of fixed positions relative to said handle, said locking means including a cavity located in said handle below said slotted opening, a spring mounted within said cavity, a pin member on top of said spring, said pin member partially extending above said cavity and into said slotted opening, said pin member being adapted to be moved further into said cavity against the restoring forces of said spring, said lower portion of said frame having a plurality of notches therein, said pin member being adapted to releasably engage a corresponding one of said notches in said lower portion of said frame in order to lock the same in a fixed position.

2. The hand held mirror of claim 1 further including a pin extending into said handle adjacent said upper end thereof, through said slotted opening and through said lower portion of said frame, said frame being adapted to pivot about said pin.

3. The hand held mirror of claim 1 wherein said lower portion of said frame includes three notches.

4. The hand held mirror of claim 1 further including a second mirror secured to the other of said opposing surfaces of said frame.

* * * * *